United States Patent [19]

Augustine

[11] 4,117,474

[45] Sep. 26, 1978

[54] COMMUNICATIONS DEVICE WITH PLURAL, POWER-OPERATED DISPLAY MECHANISMS SELECTIVELY CONTROLLED BY AN OPERATOR

[76] Inventor: Lloyd E. Augustine, P.O. Box 3175, University of Oregon, Eugene, Oreg. 97403

[21] Appl. No.: 743,112

[22] Filed: Nov. 19, 1976

[51] Int. Cl.[2] ..... G09F 9/00

[52] U.S. Cl. ..... 340/325; 340/379

[58] Field of Search ..... 340/325, 379, 319

[56] References Cited

U.S. PATENT DOCUMENTS

| | | | |
|---|---|---|---|
| 2,517,559 | 8/1950 | Haigh et al. | 340/325 |
| 3,267,456 | 8/1966 | Morris et al. | 340/325 |
| 3,482,240 | 12/1969 | Solari | 340/325 |
| 3,491,354 | 1/1970 | Tschumi | 340/325 |
| 3,848,249 | 11/1974 | Meiri | 340/325 |
| 3,928,846 | 12/1975 | Arai et al. | 340/325 |

*Primary Examiner*—Marshall M. Curtis

*Attorney, Agent, or Firm*—Kolisch, Hartwell, Dickinson & Stuart

[57] ABSTRACT

A communications device including plural, power-operated display mechanisms selectively controllable by the operator of the device whereby each may be made to display an information symbol selected at the will of the operator. The device may include a scan system, operable to place selectively different ones of the display mechanisms in a standby condition, with a mechanism when such is in a standby condition being susceptible to starting and stopping as controlled by the operator. A noise-responsive control is specifically disclosed.

9 Claims, 3 Drawing Figures

COMMUNICATIONS DEVICE WITH PLURAL, POWER-OPERATED DISPLAY MECHANISMS SELECTIVELY CONTROLLED BY AN OPERATOR

This invention relates to a communications device, and more particularly to a device which may be utilized by severely handicapped, non-vocal persons in communicating with other people.

Further explaining, cerebral palsy children and adults exist who have no functional speech and substantially no voluntary muscle control. Communication is limited with respect to these people to yes and no questions, and perhaps gross pointing on simple language boards. These approaches do not provide for expressing original wants, desires or opinions, and obviously persons so afflicted are missing a very important part of the life experience.

A general object of the invention, therefore, is to provide an improved communication device capable of being operated by severely handicapped, non-vocal people and providing a means whereby such people may express themselves.

The communication device contemplated may be constructed in such a manner as to enable a person with only minimal muscle control to operate the device. For example, the communications device may be controlled simply by grunting using an audio control system, or by a head movement using a mechanical switch-type control.

Other objects of the invention include the provision of a communication device which is producible at relatively low cost, substantially maintenance free and reliable. Obviously, substantial expense is involved in caring for handicapped persons of the type for which the device is designed, and providing for such a person's need in an economically feasible and maintenance free manner is an important consideration.

More specifically, an object of the invention is a provision of a communications device which includes plural information display mechanisms arranged as a tier or bank in the device. Each information display mechanism, when placed in an operating or running state, displays in succession and for a predetermined time interval (which may be adjusted to fit the skill of the operator) different information symbols, such as letters in the alphabet, or perhaps drawings or pictures of objects such as clothing items, food, and the like, considered frequently to be a part of the user's thought process. By controlling the point in time when a display mechanism stops, the user can select, in effect, the particular symbol which the user desires to display in the mechanism.

Yet another object of the invention is to provide a communication device of the above general character, wherein a display mechanism includes plural plate elements mounted on a movable carrier. With movement of the carrier, successive plate elements are brought into view of the user to display a marking carried on a face thereof. By employing such a system, it is an easy matter to change the particular marking displayed. For instance, such can be done by securing a covering on the face with this covering having a different marking thereon. Alternatively, the plate element may be made removable and the symbol changed by inserting another plate.

In a preferred embodiment of the invention and where a tier or bank of display mechanisms are provided, an automatic scanning system is incorporated wherein the display mechanisms, selectively and in sequence, and for a predetermined time interval, are placed in a standby state. Starting (and stopping) of a display mechanism is controlled by the operator of the device with a start-stop control, and the particular display mechanism which is started is the one which is in a standby state when the start-stop control is actuated. After a display mechanism is started, through control of the operator, scanning stops and is not resumed until the display mechanism has been stopped.

Preferrably the speed at which different display mechanisms are placed in a standby state, i.e. the scanning speed, is controllable to accommodate the operating skill of the user of the device. Preferably, also, the speed at which a display mechanism operates (whereby the speed at which different letter, characters or other symbols are presented to view) is also controllable, again to accommodate the operating skill of the user.

These and other objects and advantages of the invention will become more fully apparent as the following description is read in conjunction with the accompanying drawings wherein.

Figure 1:
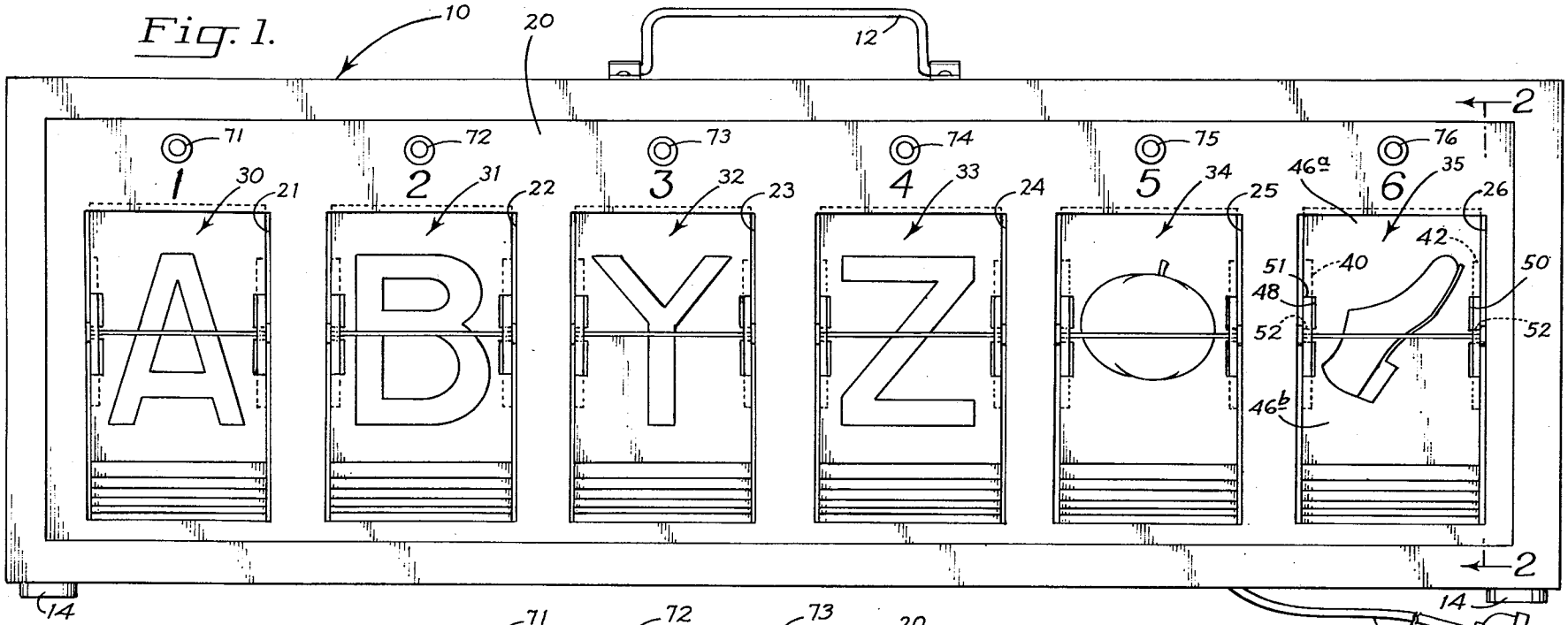
FIG. 1 is a side elevation view of a communications device as contemplated according to an embodiment of the invention, the figure illustrating a row or tier of window apertures provided along a side of a housing device, each window aperture framing a power-operated display mechanism.

Referring now to the drawings, and first of all more particularly to FIG. 1, the communications device illustrated comprises a housing generally shown at 10, which may be of substantially box-like configuration. The device illustrated is a portable one, and toward this end a handle 12 is mounted on the top of the housing to facilitate transport of the device from one location to another. Pads 14 at the base of the housing support the housing on a table or other supporting surface. Portions of an electric cord and plug used in connecting the power-operated equipment within the housing to an electrical source are shown at 16.

Housing 10 includes a front or viewing side 12 which is visible to the person operating the communications device. Arranged in a tier or row along the length of viewing side 20 are plural window apertures designated at 21–26, respectively. Each of these window apertures frames the visible portions of a power-operated display mechanism, indicated for the window apertures at 30–35, respectively.

The various display mechanisms are substantially similar in construction, and thus only one will be described in detail. Generally speaking, each display mechanism, after such has been started and when in an operating state, displays to the viewer in succession, and recurrently different letters, numerals, pictures, etc., referred to herein broadly as information symbols.

Figure 2:
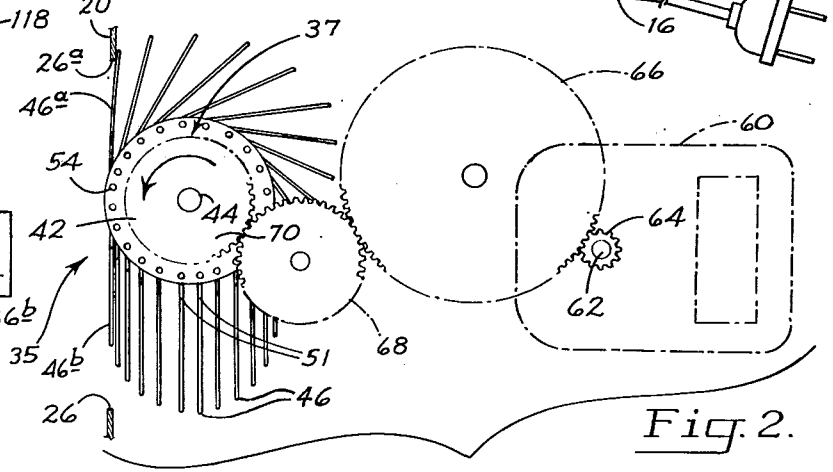
FIG. 2 is a simplified, cross-sectional view, taken generally along the line 2—2 in FIG. 1, illustrating details of a power-operated display mechanism.

Further considering the construction of a display mechanism, and referring now to FIGS. 1 and 2, wherein details of display mechanism 35 are illustrated, the display mechanism shown comprises what is referred to as a carrier or spool 37, including opposed, spaced end plates 40, 42 of circular outline joined to a shaft 44 connecting centers of these end plates. This shaft is suitably journaled adjacent its opposite ends in suitable framework provided within the housing (not shown).

Mounted on the end plates of the movable or rotatable carrier are multiple plates indicated at 46. The plates which are actually viewable through window opening 26 on the front or viewing side of the housing have been given reference numerals 46*a*, 46*b*. Each plate, as can be seen with reference to plate 46*a*, is substantially rectangular in outline. The plate is notched on opposite margins as indicated at 48 and 50. These notches present finger projections 52 which are located adjacent the bottom margin of plate 46*a* in FIG. 1 which are received within opposed apertures 54 provided in end plates 40, 42. In this way, each of the plates is pivotally supported on the end plates 40, 42 of the spool or carrier. The mountings for the respective plates are circumferentially distributed about the end plates 40, 42, as best illustrated in FIG. 2.

The operation of the carrier and the plates which are mounted thereon should be obvious. As shown in FIG. 2, those plates 46 below the carrier hang freely from the end plates in the spool, with shoulders 51 defined by the notches spaced below the circumferential edges of the end plates in the carrier or spool. The plates 46 at the upper part of the carrier or spool in FIG. 2 have an inclined position, defined by the shoulders contacting the circumferential edges of these end plates. Plate 46*a* has its upper margin against the back side of margin 26*a* of window opening 26.

With rotation of spool or carrier 37 in a counterclockwise direction to FIG. 2, plate 46*a* moves downwardly in FIG. 2 with its upper margin finally moving free of margin 26*a*. When this occurs, the plate flips over to assume a depending position and the plate behind plate 46*a* in FIG. 2 assumes essentially the position plate 46*a* formerly occupied. This has the effect of presenting to the viewer the front side of the next following plate and the rear side of the plate formerly exposed at the top of the window aperture.

The display mechanism is operated by energizing electric motor 60 including an output shaft 62 drivingly connected by gears 64, 66, 68 and 70 to shaft 44 of the carrier.

With operation of the display mechanism, successively and recurrently different information symbols are displayed to the viewer through the window aperture which frames it. In the case of display mechanism 35, the front side of plate 46*a* and the back side of plate 46*b* collectively display a picture of a shoe. The front side of the next following plate and the back side of plate 46*a* exposed with initial advancement of the display mechanism would display a different information symbol. In the device illustrated in FIG. 1, it will be noted that display mechanism 36 is provided on its flip plates with letters of the alphabet and this is also true of mechanisms 31, 32 and 33. Mechanism 34 has pictured on the flip plates disclosed, a food item.

Referring to FIG. 1, mounted on front side 20 of the housing, directly above the window aperture which frames each display mechanism, is an electric lamp or light source, indicated, respectively, at 71–76. As will be hereinafter apparent, a control system is incorporated with the device operable to place, selectively, and in a predetermined sequence, ordinarily successively, selected ones of the display mechanisms in what is referred to as a standby state. The user of the device has at his control the starting and stopping of a display mechanism, the particular mechanism which is started being that which is in a standby state at the particular time. The light sources or lamps described constitute a scan indicating means for designating selected ones of the display mechanisms, and are controlled in such a manner whereby the display mechanism which is designated by illumination of the light source or lamp is the particular display mechanism which at any given time is in a standby state.

Figure 3:
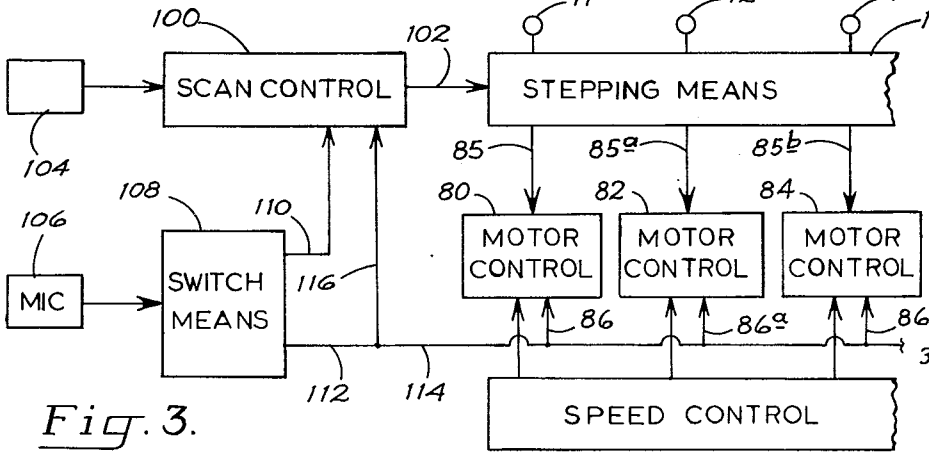
FIG. 3 is a simplified schematic illustration of a control system that may be incorporated with the device.

A control system such as might be incorporated with the display device is illustrated in FIG. 3 schematically. It should be understood that the type of control system utilized, insofar as specifics is concerned, is subject to considerable variation. The illustrated system of FIG. 3 is exemplary only of one of many different configurations that are possible that would produce the results desired.

Referring to FIG. 3, indicated by the blocks 80, 82, 84 are motor controls for the electric motors powering the various display mechanisms, as exemplified by motor 60. Only three have been illustrated, but obviously with six display mechanisms provided, several have been eliminated from FIG. 3 for simplicity.

Motor controls 80, 82, 84, are conventional, and each is constructed, and with reference to motor control 80, so that on receiving a sustained signal simultaneously from conductors 85, 86, the motor control will start the motor associated therewith, and thus operation of the display mechanism which is driven by such motor. With a sustained signal present only in conductor 85, motor control 80 is in a standby state. Motor control 82 operates in a similar manner, as controlled by conductors 85*a*, 86*a*, as does motor control 84, as controlled by conductors 85*b*, 86*b*.

Shown at 90 is a speed control for the various motor controls. Adjustment of the speed control controls the speed at which the various motors run when such are placed in a running or operating state as controlled by their respective motor controls.

With continued reference to FIG. 3, indicated at 100 is a scan control. On first receiving a signal from a conductor 110, the scan control produces a signal pulse in conductor 102. The scan control includes an oscillator of conventional form, and a counter for such oscillator, operable to produce in conductor 102 a signal pulse after counting a predetermined number of oscillations in the counter. As a result, and with the scan control operating, a signal pulse is produced in conductor 102 at regular intervals. A counter control 104 is provided, which enables adjustment to be made in the number of counts required to produce a signal pulse in conductor 102, and thus the frequency at which the signal pulses appear in conductor 102. In a typical case, counter control 104 might permit adjustment in the frequency of signal pulses emitted, within the range of about ½ second (a setting selected for a very skilled operator) and 25 seconds (a setting selected for a novice operator of a highly handicapped nature).

The scan control also includes a reset for the counter therein, operable when actuated to set the counter at zero or in a start count condition.

The communications device illustrated in the drawings is of the type that a handicapped person controls by emitting a noise such as a grunt, etc. Such noise is picked up by a microphone 106, or start-stop control which delivers a signal to amplifier and switch means 108. Switch means 108 is constructed to deliver a sustained signal, either to conductor 110 or conductor 112, with the particular conductor receiving the signal changing on means 108 receiving a signal from microphone 106. That is to say, with conductor 112 receiving a signal, and on the microphone picking up a grunt, conductor 112 then receives a signal to the exclusion of conductor 110, and on means 108 receiving a subsequent signal from the microphone, conductor 110 again receives the signal to the exclusion of conductor 112. Conductor 112 connects to conductor 114 connected to conductors 86, 86*a*, 86*b* earlier described, so that a signal in conductor 112 is transmitted to the motor controls. Conductor 112 is also connected by conductor 116 to scan control means 100.

The oscillator in scan control means 100 starts with a signal delivered thereto by conductor 110. The oscillator stops with interruption of signal delivery by conductor 110, and the counter in the control means 100 is reset on receiving a signal from conductor 116.

Signal pulses produced by scan control means 100 are delivered by conductor 102 to stepping means 118. Stepping means 118 functions to deliver a sustained signal, selectively, to one of the conductors 85, 85*a*, 85*b*. Assuming that a sustained signal is being delivered by conductor 85 to motor control 80, on then receiving a signal pulse from conductor 102, stepping means 118 operates to shift the sustained signal appearing in conductor 85 to conductor 85*a*. A subsequent signal pulse in conductor 102 results in a sustained signal being delivered to conductor 85*b* with stoppage of such a signal in conductor 85*a*. The process continues until the motor control for the last in the line of display mechanisms receives the signal, and at such time, and on a subsequent signal pulse being delivered by conductor 102, the signal is shifted to conductor 85 and motor control 80 with the operation described being repeated.

Light sources or lamps 71, 72, 73 are also shown connected to the stepping means. With a signal in conductor 85, current is supplied lamp 71 whereby it is energized, and likewise lamps 72, 73, etc. are selectively energized with a signal in conductors 85*a*, 85*b*, respectively. Thus, when motor control 80 is in a standby condition or state by reason of a sustained signal in conductor 85, lamp 71 lights. Lamp 72 lights with a signal in conductor 85*a*, etc.

Explaining the operation of the device, with the control system turned on, and in the absence of receiving any signal from microphone 106, scan control means 100 is effective at regular intervals to deliver, through conductor 102, a signal pulse to stepping means 118. Assuming a condition wherein a sustained signal is being delivered through conductor 85 to motor control 80, this places motor control 80 (and the display mechanism powered by the motor regulated by the motor control) in a standby state. Upon a pulse signal being transmitted through conductor 102 to the stepping means, the sustained signal is then delivered to conductor 85*a* to place motor control 82 in a standby state. A subsequent pulse signal in conductor 102 places motor control 84 in a standby state. Thus, selectively, different ones of the motor controls (and the display mechanisms which they regulate) are placed in a standby state. This constitutes a scan phase of operation. The scan indicating means in turn, i.e. the lamps described, designate the particular display mechanism which is in the standby state.

On microphone 106 picking up an audio sound produced by the user, i.e., the handicapped person, switch means 108 is actuated whereby the signal produced by the switch means is transferred to conductor 112. This signal is transmitted to scan control means through conductor 116. With signal delivery stopping from conductor 110 the oscillator of means 100 stops, and with a signal delivered via conductor 116 to means 100, the counter of means 100 is reset. The signal in conductor 112 is delivered also to the various conductors 86, 86*a*, 86*b* connected to motor controls 80, 82, 84. The particular motor control which is in a standby state (by reason of receiving a sustained signal from stepping means 118) is actuated upon simultaneously receiving a signal from conductor 114, to start the motor regulated by the motor control.

The carrier in the display mechanism powered by this motor then starts to turn. Different information symbols appear to the viewer at regular time intervals (the length of such time interval being preset and being determined by the speed at which the motor runs). At such time as the user of the device sees the particular symbol which he wishes to communicate to the observer, the user delivers an audio signal to the microphone. This actuates switch means 108 whereby the signal emitted therefrom is transferred to conductor 110. A scan phase of operation is then reinstated, with the immediate emission of a signal pulse to conductor 102 causing a succeeding motor control means to be placed in a standby condition, the oscillator of means 100 starting, and the counter in the scan control means after a given count then sending out another pulse signal to continue the scan phase of operation.

It should be obvious from the above description that a user of the device is enabled to select different letters or other information symbols in the various display mechanisms, to spell a word or convey a thought to another person viewing the display side of the communications device. The device is readily controlled by the user, with a minimal amount of effort, through an audio sound as in the embodiment described above, or with a controllable body movement (where the microphone is replaced with a switch device actuatable by such a body movement). With practice, a person's dexterity in manipulating the device improves, enabling adjustments to be made which increase the scan speed at which different display mechanisms are placed in a standby condition, and which increase the speed with which successive symbols of a display mechanism are portrayed to the viewer.

Information symbols carried on the plates of the display mechanism may be changed to adapt to the interest, age, etc. of the particular user. This can be done, either by pasting cover strips on the sides of the flip plates containing different markings, or by removing plates from the carrier (by deforming them slightly whereby their finger projections are pulled out of the orifices in the end plates), and substituting new plates. This is a distinct advantage deriving from the use of plates as the means displaying the information.

A device as contemplated may be constructed to be portable, whereby it is easily moved from one place to another. The device may be externally powered, as in the embodiment described, or battery powered where electrical outlets are not available.

The claims hereinafter set forth define the invention, covering the embodiments set forth herein as well as obvious variations and modifications.

What is claimed is:

1. A communications device comprising a housing, plural power-operated information display mechanisms exposed on one side of the housing, each mechanism when in an operating state displaying recurrently and in succession different information symbols, scan indicating means for designating selected ones of said display mechanisms, and control means controlling operation of said display mechanisms and said scan indicating means, said control means including scan means producing a scan phase of operation where selectively and recurrently different ones of said display mechanisms are placed in a standby state and the scan indicating means operates to designate the particular display mechanism placed in such standby state, said control means additionally including means controlled by the operator of the communications device actuatable to start and actuatable to stop operation of a display mechanism when such is in a standby state as produced by said scan means, the scan means of said control means being constructed to discontinue the scan phase of operation with one of the display mechanisms operating.

2. The communication device of claim 1, wherein said scan means of said control means places the display mechanisms in standby states during said scan phase of operation for predetermined time intervals, the scan phase of operation is reinstated automatically with the stopping of operation of a display mechanism, and said scan phase of operation is reinstated with a display mechanism different from mechanism just stopped being placed in a standby state.

3. The communication device of claim 1, wherein a display mechanism includes multiple plates mounted on a movable carrier constructed and arranged so that with movement of said carrier different ones of said plates have their faces exposed to view, said faces carrying the information symbols.

4. The device of claim 1, wherein each display mechanism comprises a rotatable carrier, a motor for rotating the carrier, multiple flip plates mounted on said carrier, the mechanism being constructed so that with rotation of said carrier different ones of said flip plates have their faces exposed to view, said faces carrying the information symbols, the display mechanism being placed in an operating state by starting of its said motor.

5. The communications device of claim 1, wherein said scan indicating means comprises a bank of light sources with an individual light source provided adjacent each display mechanism, and the scan means of said control means in the scan phase of operation energizes selected light sources.

6. A communications device comprising a housing, window apertures disposed in a row along a side of the housing, a power-operated display mechanism framed by each window aperture, each display mechanism when in an operating state displaying recurrently and in succession different information symbols through the window aperture framing the mechanism, each display mechanism including a movable carrier and multiple plates mounted on said carrier constructed and arranged so that with movement of said carrier, different ones of said plates have their faces exposed to view, said faces carrying the information symbols, scan indicating means for designating selected ones of said display mechanisms, and control means controlling operation of said display mechanisms and said scan indicating means, said control means including scan means producing a scan phase of operation where selectively and recurrently different ones of said display mechanisms are placed in a standby state and the scan indicating means operates to designate the particular display mechanism placed in said standby state, said control means additionally including means controlled by the operator of the communications device actuatable to start operation of a display mechanism when such is in a standby state as produced by said scan means and actuatable to stop operation of the display mechanism after operation of the mechanism has been started.

7. The communications device of claim 6, wherein said scan means of said control means places the display mechanism in standby states for predetermined time intervals, and wherein said scan means includes means for adjusting the length of said time intervals.

8. The communication device of claim 6, wherein a display mechanism includes means for adjusting its speed of operation and the speed at which successive plates are exposed to view.

9. The communication device of claim 6 wherein the scan means of said control means is constructed to discontinue the scan phase of operation with one of the display mechanisms operating and constructed to reinstate the scan phase of operation automatically with the stopping of operation of a display mechanism, reinstatement of the scan phase of operation operating to place a display mechanism different from the mechanism just stopped in a standby state.

* * * * *